US006662866B1

(12) United States Patent
Heath

(10) Patent No.: US 6,662,866 B1
(45) Date of Patent: Dec. 16, 2003

(54) ENERGY CONSERVATION MODERATING SYSTEM

(75) Inventor: David A. Heath, Winter Springs, FL (US)

(73) Assignee: Encon International, Inc., Lake Mary, FL (US)

( * ) Notice: Subject to any disclaimer, the term of this patent is extended or adjusted under 35 U.S.C. 154(b) by 0 days.

(21) Appl. No.: 09/806,843

(22) PCT Filed: Jun. 20, 2000

(86) PCT No.: PCT/US00/16942

§ 371 (c)(1),
(2), (4) Date: May 22, 2001

(87) PCT Pub. No.: WO01/98712

PCT Pub. Date: Dec. 27, 2001

(51) Int. Cl.[7] ..... F23N 5/20; G05D 23/00
(52) U.S. Cl. ..... 165/267; 236/46 R
(58) Field of Search ..... 236/47, 46 R; 165/267

(56) References Cited

U.S. PATENT DOCUMENTS 4,314,665 A * 2/1982 Levine ..... 236/46 R
4,453,590 A * 6/1984 Holliday et al. ..... 62/157 X
4,485,966 A * 12/1984 Cartmell et al. ..... 62/231 X
4,725,001 A * 2/1988 Carney et al. ..... 236/46 R
6,264,110 B1 * 7/2001 Proffitt et al. ..... 236/47 X

* cited by examiner

*Primary Examiner*—William Wayner
(74) *Attorney, Agent, or Firm*—Edward M. Livingston, Esq.

(57) ABSTRACT

An energy conservation moderating system has a DPDT switch (16) in switching communication intermediate a micro controller (8) and a temperature-difference generator (7). The micro controller is in switching control of the temperature-difference generator programmably through the DPDT switch in option to switching control of the temperature-difference generator by a conventional thermostat (1). The micro controller is preferably a Z 8 micro controller having a memory into which an application-specific program in the microcontroller is loaded for programmably plural-cycle short-time on-and-off switching for savings run times intermediate temperature-band on-call extremes and temperature-band mediums of a temperature-band fluctuation selectively. A timing controller (60) of on-and-off switching by the micro controller overrides switching control by the conventional thermostat with short-time cycling of on-and-off switching and returns switching control to the conventional thermostat automatically by delay of timing of on-switching to proximate on-switching timing by the conventional thermostat. This is a failsafe control circuitry (12) in event of failure of or intentional overriding of the energy conservation moderating system.

14 Claims, 3 Drawing Sheets

ENERGY CONSERVATION MODERATING SYSTEM

BACKGROUND OF THE INVENTION

This invention relates to conservation of electrical energy for heating and cooling structural enclosures by use of a switch system that overrides conventional thermostatic controls to optimize on-and-off cycling and levels of current in relationship to temperature and power requirements of electrical heating and cooling mechanisms.

Use of power cycling to conserve energy consumed by electrical heating and cooling mechanisms is well known, but not with a conservation switch system that overrides conventional thermostatic controls to optimize on-and-off cycling and levels of current use in relationship to temperature and power requirements in a manner taught by this invention.

Conventional thermostatic control of on-and-off switching of electrical heating and cooling mechanisms requires mechanism structure for overheating above desired temperature settings for heating and overcooling below desired temperature settings for cooling. Between the overheating for heating and the overcooling for cooling, there are mechanism-off periods for mechanism rest while temperatures inside of heated and cooled structural enclosures fluctuate in oscillation cycles correspondingly. As a result, oscillational operation of the mechanisms controlled by conventional thermostats results in an undue use of power.

The present invention can eliminate the undue use of power, thus conserving electrical energy.

Although prior devices exist which might conserve energy, none accomplishes that task in a manner or as well as the present invention. An energy management control system for programmed cycle control to diminish this rate of use of power is described in U.S. Pat. No. 4,509,585, issued to Carney, et al. on Apr. 9, 1985. Carney, et al. is limited, however, to predetermined computer controls that are not application specific in a manner taught by this invention.

Examples of other known related but different energy management systems are described in the following patent documents. U.S. Pat. No. 5,816,491 issued to Berkeley, et al. on Oct. 6, 1998 discloses a method and device for conserving energy during peak loads by reducing fuel consumption. U.S. Pat. No. 5,678,758, issued to Takegawa, et al. on Oct. 21, 1997, describes a device for controlling a heating and cooling system by maintaining a temperature at a rate not detectable to occupants and saves energy at the same time through control of compressor run times. U.S. Pat. No. 5,428,252, issued to Walker, et al. on Jun. 27, 1995, described a computer system for adjusting power requirements of heating and cooling mechanisms to power available in power lines due to brownouts. U.S. Pat. No. 5,159,217, issued to Mortensen, et al. on Oct. 27, 1992, described a brownout protection and reset device which uses a microprocessor to delay resumption of operations for a preset time interval after a brownout. U.S. Pat. No. 5,115,968, issued to Grald on May 26, 1992, described a method and apparatus for controlling a heating and cooling system that uses a temperature error based on an on/off signal of a thermostat to control cycle time. U.S. Pat. No. 4,817,862, issued to Bhattacharya on Apr. 4. 1989, described a control valve for a gas heating system which includes thermostatic switching hardware. U.S. Pat. No. 4,817,705, issued to Levine, et al. on Apr. 4, 1989, described a thermostatic control device that uses a duty cycle basis in which ambient and desired temperatures are compared to arrive at an adjustment of run time so the thermostat does not have to be constantly adjusted to maintain a comfortable temperature. U.S. Pat. No. 4,655,279, issued to Harmon, Jr. on Apr. 7, 1987, described a system of controlling heating and cooling of a building with use of a thermostat with drift ramping and hold time to save energy.

The device of the present invention realizes much of its savings from the inherent over sizing built into most HVAC&R systems. The equipment of such systems is typically sized according to the amount of conditioned area needed, desired temperature, load factors, interior and exterior architecture, exposures and regional climate. The regional temperature data used is of an extreme nature, the hottest or coldest climate conditions which can be experienced in the region annually for a thirty day period. With this in mind, it is a known factor that the equipment runs at peak load for a very brief period to handle such load demands.

The logic of the present invention takes advantage of the latter design criteria by cycling the temperature generating unit off and on in a programmed optimization schedule. The latter control attempts to satisfy the heating or cooling demand with less cumulative run time on the respective conditioning plant. The goal is to eliminate the superheating and cooling which widely occurs in commercial and residential environments.

The present device accomplishes its mission by constant polling the control line(s) for calls for running the temperature generating unit. This communication will state how long a call has been present, how long the equipment has run, and when it becomes satisfied or does not. With the information gathered internal decisions are made regarding run time adjustments. Demand levels may dictate adjustments to the program, increases dictating longer runs while decreases dictate shorter runs. The end result is to reduce consumption of electric, gas and oil driven equipment which the device is addressing.

Other advantages of utilizing the present device in addition to the energy saving benefits are realized in maintenance and safety areas. The unit prohibits short cycling of any compressor-driven cooling plant. The unit incorporates a delay feature which disallows any potentially damaging quick restart. The compressor will not start until four minutes have passed since the last call was completed.

The present device also addresses the inability of the equipment involved to reach a temperature satisfaction point. An automatic override in the present device allows the equipment to run without interruption, if after a preset time, for example forty minutes, the desired setting has not been reached. This feature eliminates the possibility of discomfort appearing due to a cycling schedule. The unit will attempt to save energy only while a window of opportunity exists. Saving energy with the sacrifice of personal, customer or goods temperature tolerances and comfort is not an option.

Also, the present device provides an internal diagnostic feature which will, in case of failure, remove the device from the circuit and return complete control to the original control means, such as a thermostat. Additionally the device has the ability to be taken out of line with a mechanical switch located on the device itself, this fail-safe is not voltage dependent and will complete the circuit under any circumstances.

SUMMARY OF THE INVENTION

Objects of patentable novelty and utility taught by this invention are to provide an energy-conservation moderating system which:

displaces conventional thermostatic single-cycle on-and-off switching of heating and cooling mechanisms with plural-cycle short-time on-and-off switching between temperature-band on-call extremes and temperature-band means of temperature-band fluctuation selectively;

operates the heating and cooling mechanisms in response to application-specific temperature detection;

conveys desired temperature differences from predetermined proximateness of the heating and cooling mechanisms to temperature-use positions selectively when not operating; and restores the conventional thermostatic single-cycle on-and-off switching of the heating and cooling mechanisms automatically for failsafe backup operation when on-time duration of the short-time on-and-off switching exceeds a preset time.

This invention accomplishes these and other objectives with an energy-conservation moderating system which interfaces with the motor control mechanism of compressors for air conditioners, coolers, and freezers. The device also interfaces with the heating control mechanisms of boilers and furnaces. These two types of equipment will collectively be described by the terms cooling and heating systems or temperature difference generators.

The present device is designed to provide savings for the operation of a cooling or heating systems. The savings are obtained by reducing the total run time of a system's compressor or heating plant. The savings are achieved without sacrificing occupant comfort for air conditioning or heating. The savings are also achieved while keeping the control area within the temperature requirements for food storage set by the United States Department of Agriculture ("USDA"). The savings are achieved without increasing the wear on the equipment. The results of which is a reduction in the total cost to operate the cooling or heating equipment.

The present device operates in conjunction with the thermostat of a cooling/heating system. It does not replace the system thermostat nor can the device operate without the thermostat. The device intercepts the control signal from the thermostat and modifies the signal using a savings algorithm. This modified signal, the output signal, is then used as a replacement which is sent to the motor or heating control mechanism. It is through this modification of the control signal from the thermostat that the savings operation is performed.

The present invention incorporates a microcontroller that provides all logic operations to produce the savings. The microcontroller is constantly monitoring the control signal from the thermostat. When there is a signal from the thermostat to turn ON the compressor or furnace, this invention determines how to operate the motor or furnace control in order to reduce the total run time of the compressor or furnace. The invention then generates a replacement signal which is sent to the motor or furnace control. This effect of this replacement signal then allows the heating/cooling system's compressor or furnace to operate at a reduced total run time. The control signal from the thermostat consists of two compressor or furnace control states: ON or OFF. This invention only modifies the ON signal from the thermostat to produce savings. The OFF signal is not modified. So when the control signal is OFF, the invention will always send an OFF signal to the compressor or furnace. When the control signal sends the device of the present invention an ON signal, then the device can send either an ON or OFF signal to the motor or furnace control. Therefore, the device will always be able to shut down the compressor or furnace during a thermostat call, but will not turn ON the compressor or furnace when there is no call.

The present invention has failsafe circuitry that "kicks in" when the main operation fails. This feature bypasses the savings operation and allows the control signal to pass through the device unaltered. During failsafe operation, the control signal from the thermostat is not intercepted by the device, but rather passes through a relay and continues to the motor or furnace control. When the failsafe circuitry kicks in, there will be no further control from the device and therefore no savings will be obtained while in failsafe mode.

The present invention incorporates a DPDT switch which can be broken down to operate as two distinct switches in a single package. These two switches are designated DPDT-1 and DPDT-2. The invention uses DPDT-2 as a power switch which allows the invention to be turned off for any purpose. When the device of the present invention is in the OFF position, the signal from the thermostat bypasses the internal operation of the invention completely. The thermostat's input signal is physically connected to the inventions's output via DPDT-1. When the invention is switched OFF, there is no contact by the control signal with the internal components of the invention. Therefore, in the OFF position, the replacement signal is identical to the control signal.

The present invention produces savings by reducing the total run time of a cooling system's compressor or heating system's furnace. These savings are achieved by modifying the control signal from the thermostat. It includes failsafe circuitry which is designed to operate in the case of a unit failure. Therefore, the invention allows the cooling or heating equipment to provide the same operational effects of a conventional heating/cooling system which uses just a thermostat alone but at a reduced operating cost.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | thermostat |
| 6. | system (energy moderator) |
| 7. | motor or furnace control (temperature generator) |
| 8. | microcontroller |

-continued

| | |
|---|---|
| 9. | power regulator |
| 10. | control signal transducer |
| 11. | failsafe drive |
| 12. | failsafe circuitry |
| 13. | output signal generator |
| 14. | output signal generator circuitry |
| 15. | failsafe relay |
| 16. | DPDT switch |
| 17. | thermal modifier circuitry |
| 18. | indicator LEDs |
| 19. | AC power supply input |
| 20. | AC power supply input |
| 21. | control signal input |
| 22. | output signal |
| 23. | inputs for thermal modifier |
| 24. | inputs for thermal modifier |
| 26. | thermal modifier |
| 27. | DPDT-1 |
| 28. | DPDT-2 |
| 29. | barrier strip interface |
| 31. | maximum temperature Tmax |
| 32. | set temperature |
| 33. | minimum temperature Tmin |
| 34. | control signal |
| 35. | control signal |
| 40. | output signal |
| 43–44. | control signal ON period |
| 45. | compressor ON |
| 46. | ON output signals |
| 47. | ON output signals |
| 48. | maximum temperature |
| 49. | minimum temperature |
| 51. | compressor runs |
| 52. | compressor OFF |
| 53. | OFF output signals |
| 60. | timer in one-shot mode |
| 61. | drive transistor |
| 62. | resister/capacitor (RC) network |
| 63. | optoisolator driver and triac combination |
| 64. | output |
| 65. | failsafe relays inputs |
| 66. | failsafe relays inputs |

Figure 1:
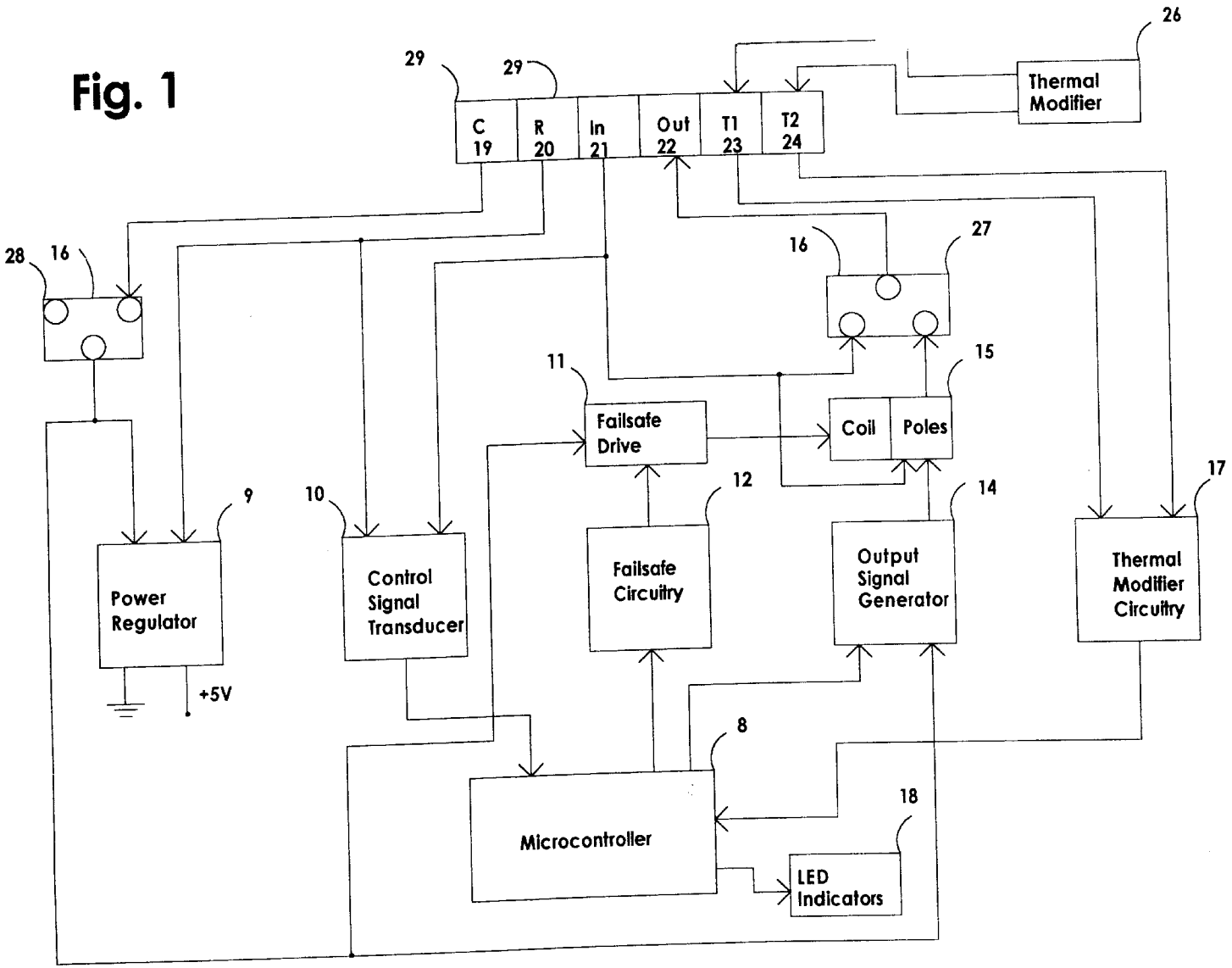
FIG. 1 is a schematic diagram of the system.
Figure 2:
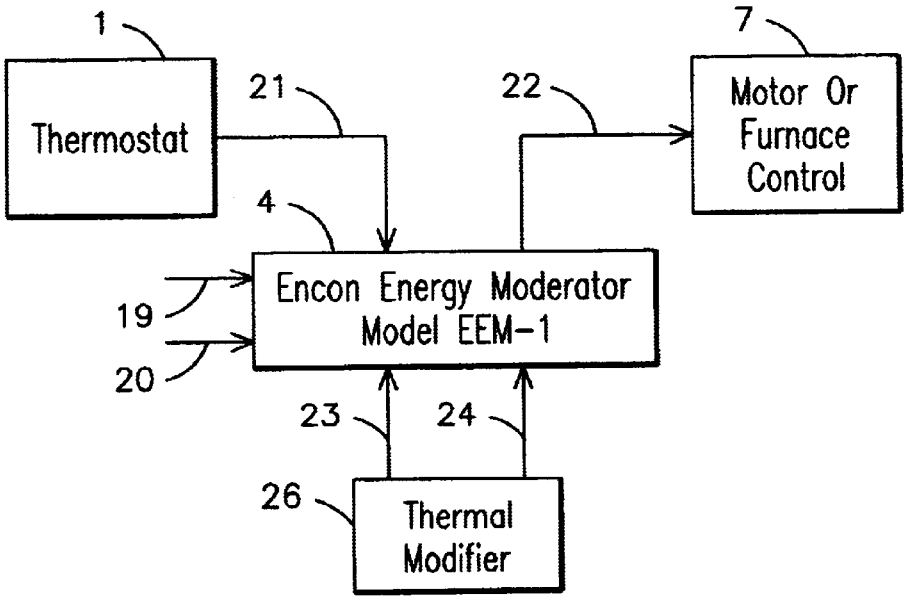
FIG. 2 is a schematic diagram of the interface of the system in a conventional heating and cooling system.
Figure 4:
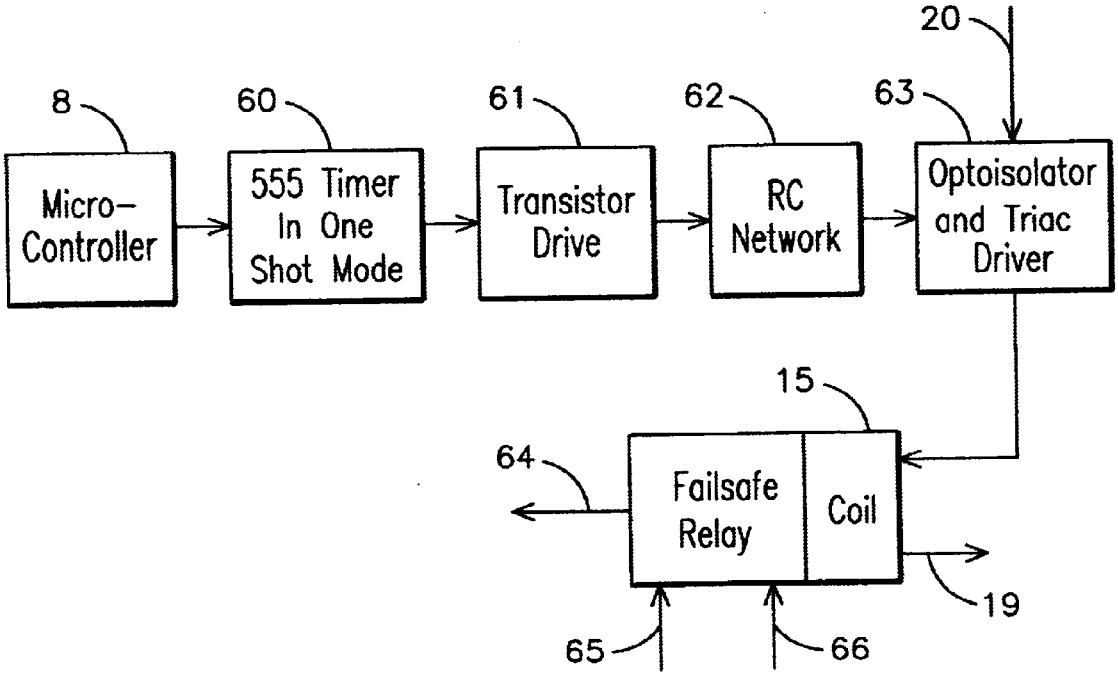
FIG. 4 is a schematic diagram of the failsafe operating portion of the system.

Referring now to the drawings, particularly FIGS. 1, 2 and 4, the system of the present invention consists of three main sections: (1) a user interface; (2) the hardware design; and (3) a savings program operation stored in the on board memory of a microcontroller 8.

The system 6 user interface consists of a barrier strip interface 29 which facilitates the connections of the AC power supply input 19 and 20, the control signal input 21 from the thermostat 1, the output signal 22 from the system 6 for a temperature difference generator, such as the motor or furnace control 7, and the inputs 23 and 24 for the thermal modifier 26 for a total of six connections for the system.

A DPDT switch 16 controls the operation of the system. The DPDT switch 16 consists of two SPDT switches in the same package. These are designated DPDT-1 27 and DPDT-2 28. In the ON position, the signal output 22 is switched to system control and simultaneously the system is given power from the AC input 19 and 20. In the OFF position, the output signal 22 is directly connected to the control signal input 21, effectively bypassing the system 6 entirely. Also, in the OFF position, AC power 19 and 20 is removed and the system 6 is switched off. This off position allows the equipment to be serviced without the effects of the savings program being in operation.

There are four indicator LEDs 18 visible for the user. The first and leftmost is the power indicator. It is on whenever the switch is in the ON position and the proper AC inputs 19 and 20 is applied. The second LED is the saving program indicator. This comes ON whenever the microcontroller 8 is executing the savings program. It can only come on when there is an ON control signal 21 from the thermostat 1. The next LED is the furnace/compressor ON indicator. It turns on whenever the signal output 22 gives an ON signal to the motor or furnace control 7. The last LED is the failsafe indicator. This turns on whenever the system is not operating properly and the unit will need to be inspected by a service technician.

The system is installed at a convenient site on the equipment. The site selection should be made so that all the necessary inputs are provided nearby. The AC power supply 19 and 20 will be tapped into at the cooling or heating equipment somewhere. The wire carrying the control signal 21 from the thermostat 1 must be identified. The control signal wire 21 will be cut and the system put in series with the control line 21. Only the system's control signal input 21 output signal 22 are used for this series connection. The final step is to mount the thermal modifier 26 in a convenient location within the ductwork and the two wires 23 and 24 connected to the system.

The hardware of the system consists of the following main sections: a microcontroller 8, a power regulator 9, a control signal transducer 10, failsafe circuitry 12 having a failsafe drive 11 and failsafe relay 15, output signal generator 13, thermal modifier circuitry 17 and thermal modifier 26, DPDT switch 16, and LED indicators 18.

The power regulator 9 provides the +5 volts that is required for the system. The system is designed to run from a 24 VAC supply. However, any AC input voltage can be provided by the cooling or heating equipment and an internal transformer used to produced the required 24 VAC single phase. If the cooling or heating equipment provides 24 VAC for power and control line voltages, the internal transformer will not be needed. This is conversion from voltage to voltage is one of the main features of the system.

The control signal transducer 10 converts the control signal input 21 to a logic state 0 or +5 V TTL signal. TTL level logic consists of two voltage levels: 0 volts is off and +5 volts is on. This TTL signal can then be used by the by the microcontroller 8. The control signal transducer 10 uses a bridge rectifier and a storage capacitor to smooth out the 24 VAC signal. This voltage is then passed through a voltage divider to bring it down to about 2 V DC. This is then compared with a reference voltage by a LM339 comparator. The LM339 provides the output: +5 V when control signal input 21 is ON and 0 V when the control signal input 21 is OFF.

The microcontroller 8 operates in a loop which is constantly polling the output of the LM339 at 1 Hz. The microcontroller 8 determines if the control signal input 21 is ON. If the control signal input 21 is ON, then the proper section of the savings program is executed. If the control signal input 21 is OFF, the system software timers are adjusted and the loop repeated (discussed in the next section—Savings Program Operation). After the microcontroller 8 determines the action that needs to be taken, the proper status is indicated on the LEDs 18.

If the microcontroller 8 determines that the signal output 22 needs to be ON, then the output signal 22 needs to be generated. This is done via the output signal generator circuitry 14. These consist of an optoisolator driver and a Triac device. This combination of driver and triac form a simple digitally controlled AC switch. The triac is supplied with R signal 20 of the AC voltage source that is used for the power supply. The microcontroller 8 simply turns this triac ON and OFF as needed. The output of the triac is the replacement signal that goes to the motor or furnace control 7.

The failsafe circuitry 12 consists of a 555 timer in one-shot mode 60. The failsafe drive 11 consist of a simple resistor/capacitor (RC) network 62, a drive transistor 61, and another optoisolator driver and triac combination 63 which is used to energize the coils of the failsafe relay 15. The failsafe relay 15 provides the switching necessary for proper operation.

Only one of the failsafe relay's 15 inputs 65 and 66 will be available for output 64. Which one depends on the energized state of the failsafe relay's 15 coil. When the coil is not energized, the output 64 will be the control signal 21. When the coil is energized, the output 64 will be the output from the output signal generator 14.

The failsafe circuitry 12 must be reset during each loop of the savings program. When the failsafe circuitry 12 is reset, the timer output goes to a TTL logic level of +5 volts (high). This high output turns on the drive transistor which charges up the RC network. The RC network's high output is used to turn on the optoisolator which then turns on the triac which powers the failsafe relay's 15 coil. At this point, the output signal 22 is the savings output produced by the system.

If the failsafe circuitry 12 is not reset because of system failure, the timer will not be reset and will drop to 0 volts (low). This low output will not turn on the drive transistor so the RC network remains discharged. This discharges state will not turn on the optoisolator and so the triac will not energize the failsafe relay's 15 coil. In this state, the system 6 is bypassed and the output signal 22 is identical to the control signal input 21 and no savings is possible. The system 6 is now in failsafe mode.

The thermal modifier 26 is an external device that attaches to the system at barrier strip 29 connections T1 23 and T2 24. The thermal modifier 26 allows feedback from the control area interface 6 to be analyzed by the microcontroller 8. This feedback is used to modify the savings program to maximize savings potential.

The nature of the system 6 allows it to be programmed for a particular application to achieve maximum savings. Some types of cooling or heating applications require different program algorithms to maximize savings. This savings program is loaded permanently into the processor's memory as required. This custom loading of code is done at the factory.

The savings program works in an infinite loop. The main points are the resetting of the failsafe circuitry 11 and polling of the control signal input 21. These two operations occur regardless of the status of the savings program. The microcontroller 8 takes several paths through the program to determine exactly what needs to be done.

The first operation of the microcontroller 8 occurs after power up. All internal registers are initialized and the microcontroller 8 automatically enters into a short cycle protection sequence. The short cycle protection period is a predetermined interval which prevents the compressor or furnace from turning on too quickly after its last run. In compressors, this is important to prevent damage to the compressor by letting pressures build too high.

The system 6 also has a bypass feature that eliminates any attempts at savings when the call period exceeds a predetermined length. In this situation, the excess capacity has been reduced due to environmental effects (for example too hot outside for an air conditioner to be able to cool the room). The system allows the equipment to run without any attempt at savings until the call has been satisfied. When the call has become satisfied, the unit will attempt to provide savings but at a less aggressive level.

The savings program operates in different levels of aggressiveness. The program is constantly adjusting itself to the demand of the cooling or heating required based on the amount of call time. If the program gets too aggressive in savings, then the bypass kicks in and the program remembers that it has become too aggressive, so it waits a predetermined period before attempting to become more aggressive. In the meantime, it still provides savings, but at a lessor extent.

The system 6 starts out in the step which provides the least savings. At that point, when a call is made, the conquest starts executing the savings program. The savings program consist of predetermined lengths of ON and OFF times for the compressor or furnace to run. The program will stay at this level of savings until a call from the thermostat 1 has been initiated and satisfied for 3 consecutive cycles. After having successfully satisfied the call for cooling or heating for 3 consecutive cycles, the system 6 advances to the next level of aggressiveness in savings.

It is important to note that if the system 6 ever goes into bypass mode, then the unit takes a step back in aggressiveness. Then it will resume its operation with the next call and provide savings at a lesser extent.

The system 6 also monitors the thermostat's 1 control signal for short cycling. Short cycling occurs when a compressor is turned off and then back on within a predetermined period. The effects of short cycling is detrimental to the internal components of the compressor. The system 6 provides protection against short cycling by the thermostat 1. The system has a built in timer that monitors how long it has been since the compressor has turned off and will not let the output signal go ON until the short cycle period has passed.

The system 6 also provides a method to assure that the temperature of the control area recovers as soon as possible. During the period that the control signal 21 is OFF, the control area is changing temperature. When the control signal 21 turns ON, that means the control area needs to have the compressor or furnace turn on to adjust the temperature. The system's microcontroller allows the compressor or furnace to turn on immediately to start the temperature change process immediately, as long as it is not a short cycle event as described in the above paragraph. After a predetermined time, then the savings scheme is activated.

Figure 3:
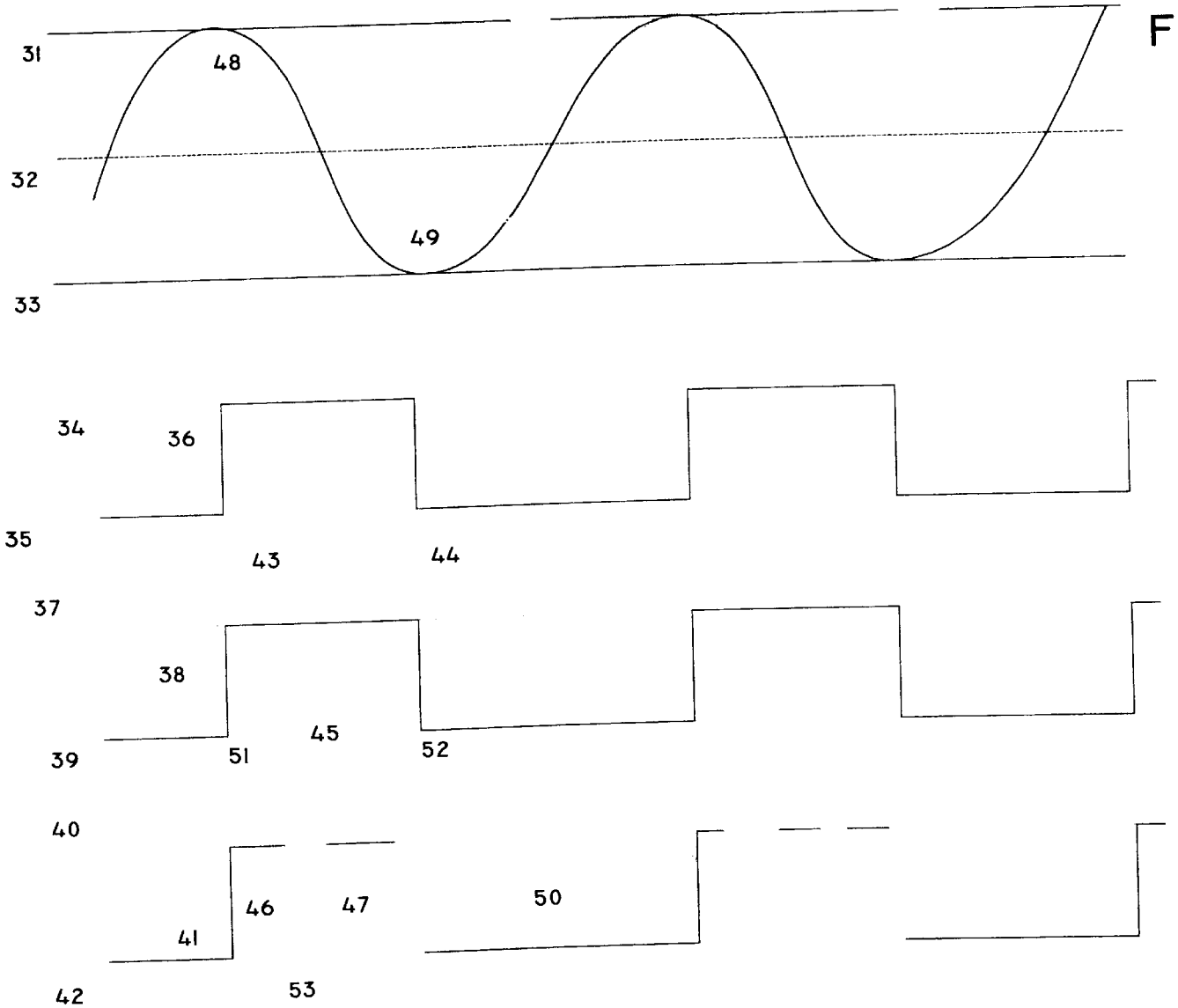
FIG. 3 is a chart of programmed plural cycling and power savings.

Referring now to FIG. 3, the power savings scheme of the present invention can be described. The temperature of a control area with an active cooling or heating system oscillates throughout the day between a maximum temperature Tmax 31 and a minimum temperature Tmin 33. The temperature range oscillates around a temperature that is desired to be maintained Tset 32. The range of this temperature band is dependent of the thermostat of the system. This temperature oscillation exist regardless of the system is heating or cooling.

For this example, a system requiring cooling will be discussed. First the nature of a cooling system without an system 6 device will be discussed. Then a cooling system with an system 6 will be discussed.

In a cooling scenario for equipment without the system of the present invention, the desired temperature Tset 32 is set on the thermostat 1. When the compressor is OFF, the room temperature rises. When it gets to a certain temperature 48, the thermostat will send a control signal 34 ON to the motor control 7. The motor will turn on and the compressor runs 51. The control area will then experience a drop in temperature 48 until it reaches the temperature Tmin 49 at which the thermostat 1 will send a control signal 35 OFF which turns the motor and compressor OFF 52.

It is during this period of compressor ON 45 that the largest expense of cooling is occurring. Any reduction in this motor and compressor run time will reduce the cost of cooling. It is important to notice that the motor and compressor are running the whole time the control signal 34 is ON. There is no savings in this scenario.

When the compressor turns off, the temperature of the control area will then start to rise. This cycle repeats as long as the cooling system is on and there is a demand for cooling.

In a cooling scenario for equipment with the system of the present invention, the room fluctuation is the same for the control area that has equipment using the present invention. What has changed is that the amount of run time for the motor and compressor; it has been reduced.

The thermostat 1 sends a control signal 34 ON to the system. The system will send an output signal 40 to the motor control (as long as it is not a power up or a short cycle event). Then the motor and compressor will turn on and the room temperature 48 will begin to drop. During this period of control signal ON 34 from the thermostat 1, the system 6 will be sending ON 46, OFF 53, and ON 47 output signals to the motor control 7. It is through this ON/OFF control that the savings are obtained.

The amount of savings is the amount of off time that can be placed into a thermostat 1 control signal ON period 43–44. The more time that the compressor can be turned off, the greater the savings.

The system 6 then continuously adjusts itself to get the most off time possible without sacrificing occupant comfort or violating USDA minimum temperature requirements for food storage.

A new and useful energy-conservation-switch system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An energy conservation moderating system comprising:

a switch in switching communication intermediate a micro controller and a temperature-difference generator;

the micro controller being in switching control of the temperature-difference generator programmably in-place of switching control of the temperature-difference generator by a conventional thermostat through the switch;

the micro controller having a selectively application-specific program and a timing controller in predetermined switching control of the temperature-difference generator through the switch; and the conventional thermostat being in switching control of the temperature-difference generator by programmably predetermined on-switching by the timing controller to proximate on-switching by the conventional thermostat as a failsafe default in event of failure or intentional overriding of the energy conservation moderating system, wherein the micro controller is a predetermined micro controller into which one or more application-specific programs are loadable; and the application-specific programs include a predeterminedly regulated on-and-off switching of the temperature-difference generator by the micro controller through the switch.

2. The energy conservation moderating system of claim 1 wherein:

the micro controller includes a first section and a second section;

the first section contains an operating system having operating routines; and the second section is receivable of application-specific programming for execution of predetermined savings-mode operation of the micro controller in accordance with the operating system.

3. The energy conservation moderating system of claim 2, wherein:

the operating system of the first section is read-only fixable;

the application-specific programming of the second section is programmable pre-determinedly for specific classes and applications of the temperature-difference generators.

4. The energy conservation moderating system of claim 2, wherein:

the operating system is read-only fixable for programming of routine including temperature-difference switching, failsafe resetting of the conventional thermostat, application-specific override of switching, and acquisition of temperature-difference data selectively.

5. The energy conservation moderating system of claim 1 wherein:

the timing controller is a single 555 timer in a one-shot mode.

6. The energy conservation moderating system of claim 1 wherein:

the switch is a DPDT switch bifurcated with a first output connection through the micro controller from a power supply and a second output connection through the conventional thermostat from the power supply to the temperature-difference generator programmably, and off-switching of the micro controller is on-switching of the conventional thermostat for switching control of the temperature-difference generator.

7. The energy conservation moderating system of claim 1 wherein:

the temperature-difference generator is a cooler;

the application-specific program of the micro controller with the timing controller includes predetermined limited-time on-switching of the cooler plurally between temperature-band highs and temperature-band mediums of temperature intermediate temperature-band fluctuation predetermined for on-and-off switching of the cooler by the conventional thermostat.

8. The energy conservation moderating system of claim 1 wherein:

the temperature-difference generator is a heater;

the application-specific program of the micro controller with the timing controller includes predetermined limited-time on-switching of the heater plurally between temperature-band lows and temperature-band mediums of temperature intermediate temperature-band fluctuation predetermined for on-and-off switching of the heater by the conventional thermostat.

9. The energy conservation moderating system of claim 1 and further comprising:

the temperature-difference generator has a cooling mode and a heating mode that are operable selectively;

the application-specific program of the micro controller with the timing controller includes predetermined limited-time on-switching of operation of the cooling mode plurally between temperature-band highs and temperature-band, mediums of temperature intermediate temperature-band fluctuation predetermined for on-and-off switching of the cooling mode of the temperature-difference generator by the conventional thermostat; and the application-specific program of the micro controller with the timing controller includes predetermined limited-time on-switching of operation of the heating mode plurally between temperature-band lows and temperature-band mediums of temperature intermediate temperature-band fluctuation predetermined for on-and-off switching of the heating mode of the temperature-difference generator by the conventional thermostat.

10. The energy conservation moderating system comprising:

a switch in switching communication intermediate a micro controller and a temperature-difference generator;

the micro controller being in switching control of the temperature-difference generator programmably in place of switching control of the temperature-difference generator by a conventional thermostat through the switch;

the micro controller having a selectively application-specific program and a timing controller in predetermined switching control of the temperature-difference generator through the switch; and the conventional thermostat being in switching control of the temperature-difference generator by programmably predetermined on-switching by the timing controller to proximate on-switching by the conventional thermostat as a failsafe default in event of failure or intentional overriding of the energy conservation moderating system, wherein the micro controller is a predetermined micro controller into which one or more application-specific programs are loadable; and the application-specific programs include a predeterminedly regulated plurality of cycles of on-and-off switching for savings run times which in total have a shorter time length than a single cycle of a conventional run time of on-and-off switching of the temperature-difference generator by the conventional thermostat.

11. An energy conservation moderating system comprising:

a switch in switching communication intermediate a micro controller and a temperature-difference generator;

the micro controller being in switching control of the temperature-difference generator programmably in place of switching control of the temperature-difference generator by a conventional thermostat through the switch;

the micro controller having an application-specific program with a timing controller in predetermined switching control of the temperature-difference generator through the switch;

the conventional thermostat being in switching control of the temperature-difference generator by programmably predetermined on-switching by the timing controller to proximate on-switching by the conventional thermostat as a failsafe default in event of failure or intentional overriding of the energy conservation moderating system;

the micro controller being a predetermined micro controller into which one or more application-specific programs are loadable;

the application-specific programs include a predeterminedly regulated on-and-off switching of the temperature-difference generator by the micro controller through the switch;

the micro controller includes a first section and a second section;

the first section contains an operating system having operating routines;

the second section being receivable of application-specific programming for execution of predetermined savings-mode operation of the micro controller in accordance with the operating system;

the operating system being read-only fixable for programming of routine including temperature-difference switching, failsafe resetting of the conventional thermostat, application-specific override of switching, and acquisition of temperature-difference data selectively;

the application-specific programming of the second section being programmable pre-determinedly for specific classes and applications of the temperature-difference generator; and the application-specific programs include a predeterminedly regulated plurality of cycles of on-and-off switching which in total have a shorter time length than a single cycle of on-and-off switching of the temperature-difference generator by the conventional thermostat.

12. The energy conservation moderating system of claim 11 wherein:

the temperature-difference generator is a cooler;

the application-specific program of the micro controller with the timing controller includes predetermined limited-time on-switching of the cooler plurally between temperature-band highs and temperature-band mediums of temperature intermediate temperature-band fluctuation predetermined for on-and-off switching the cooler by the conventional thermostat.

13. The energy conservation moderating system of claim 11 wherein:

the temperature-difference generator is a heater;

the application-specific program of the micro controller with the timing controller includes predetermined limited-time on-switching of the cooler plurally between temperature-band lows and temperature-band mediums of temperature intermediate temperature-band fluctuation predetermined fork on-and-off switching of the heater by the conventional thermostat.

14. The energy conservation moderating system of claim 11 and further comprising:

the temperature-difference generator has a cooling mode and a heating mode that are operable selectively;

the application-specific program of the micro controller with the timing controller includes predetermined limited-time on-switching of operation of the cooling mode plurally between temperature-band highs and temperature-band mediums of temperature intermediate temperature-band fluctuation predetermined for on-and-off switching of the cooling mode of the temperature-difference generator by the conventional thermostat; and the application-specific program of the micro controller with the timing controller includes predetermined limited-time on-switching of operation of the heating mode plurally between temperature-band lows and temperature-band mediums of temperature intermediate temperature-band fluctuation predetermined for on-and-off switching of the heating mode of the temperature-difference generator by the conventional thermostat.

* * * * *